United States Patent [19]

Fuller

[11] Patent Number: 4,462,186

[45] Date of Patent: Jul. 31, 1984

[54] SELF-ADJUSTING WINDOW UNIT WITH CORNER ASSEMBLY

[76] Inventor: LeRoy C. Fuller, P.O. Box 3564, Logan, Utah 84321

[21] Appl. No.: 443,593

[22] Filed: Nov. 22, 1982

[51] Int. Cl.[3] ..... E06B 3/32; E06B 3/54

[52] U.S. Cl. ..... 49/463; 49/62; 160/376

[58] Field of Search ..... 49/463, 62, 55, 57, 49/61; 160/381, 374–376, 372

[56] References Cited

U.S. PATENT DOCUMENTS

| | | | |
|---|---|---|---|
| 2,555,138 | 5/1951 | Knorr | 160/376 X |
| 2,593,258 | 4/1952 | Breuer | 160/376 X |
| 2,597,484 | 5/1952 | Heilig | 160/376 X |
| 4,196,545 | 4/1980 | Korany et al. | 49/463 |

*Primary Examiner*—Philip C. Kannan

*Attorney, Agent, or Firm*—B. Deon Criddle

[57] ABSTRACT

A self-adjusting window frame unit having a corner assembly that will permit continued adjustment of the frame while providing strength for the frame at the corners and while maintaining a fully insulated frame. The unit includes right-angle corner members adapted to receive window end members having angled ends and with the corner members having projecting legs with extending side faces on opposite sides thereof to fill spaces left by notches provided in the end members. Alternatively the end members may extend into opposite legs of the corner members and the corner members may be hinged to permit relative movement of the end members to fit a window opening. With the hinged corner member the legs of the corner member are overlapping so that no air gap will develop between the legs as the legs move relative to one another.

3 Claims, 4 Drawing Figures

SELF-ADJUSTING WINDOW UNIT WITH CORNER ASSEMBLY

BACKGROUND OF THE INVENTION

1. Field of the Invention

The present invention relates to a window structure that is adapted for easy installation in and removal from a conventional window frame. It is particularly concerned with a self-adjusting window structure that can be easily fitted into and removed from a conventional window frame that is not entirely rectangular in configuration.

BRIEF DESCRIPTION OF THE INVENTION

2. Prior Art

U.S. Pat. No. 4,196,545, discloses a window structure that may be press fitted into a conventional window frame and that has exterior framing components that can be angularly varied with respect to one another as the window is fitted into a frame, while still maintaining the glass or plastic material from which the windowpane is made in a supported condition.

In using the window of U.S. Pat. No. 4,196,545, it has been found that if the window frame in which the window is to be inserted is significantly out of square, i.e., has corners that are other than right angles, the window structure will deform to fit within the window frame, but it is not uncommon that gaps be left where the side members surrounding the window separate. Such gaps are undesirable since the window then fails to provide necessary insulation or to keep insects, or the like, from entering the building in which the window is positioned.

OBJECTS OF THE INVENTION

Principal objects of the present invention are to provide a window assembly that can be easily inserted into and removed from a window frame and that will adjust to fit irregular angles of the frame while fully filling the opening of the frame.

Other objects are to provide such a window assembly that is economical to construct, that can utilize windowpanes of various materials such as glass, acrylic resin, or other transparent materials and to provide a window assembly that can be used either as a single-pane window or as a storm window mounted in the same frame as another installed window assembly.

PRINCIPAL FEATURES OF THE INVENTION

Principal features of the invention include side members adapted to fit around all four sides of a rectangular windowpane, said windowpane being made of glass, acrylic resin, or other suitable transparent material; spring means adapted to fit within grooves inside members to which the edges of the windowpane fit and corner members adapted to interconnect the side members and hold the assembly together. The corner members include side faces adapted to serve as the sidewalls for grooves in the side members as the side members move relative to one another. Alternatively the corner members may be hinged with one leg arranged to slide over the other during installation or removal of the window assembly. Pivot pins inserted through the side members and the windowpane hold the assembly together.

Additional objects and features of the invention will become apparent from the following detailed description and drawing, comprising a complete description of the invention.

THE DRAWING

In the drawing:

FIG. 1 is a perspective view of a window assembly of the invention, showing a windowpane, with side members therearound and corner members interconnecting adjacent side members;

FIG. 2, an exploded perspective view showing the window assembly of FIG. 1;

FIG. 3, an exploded, enlarged, side elevation view showing one embodiment of corner member with adjacent side members exploded therefrom and shown fragmentarily and with the corner member partially broken away to show the back and side plates; and FIG. 4, a view like FIG. 3, but showing an alternative embodiment of corner member.

DETAILED DESCRIPTION

Figure 1:
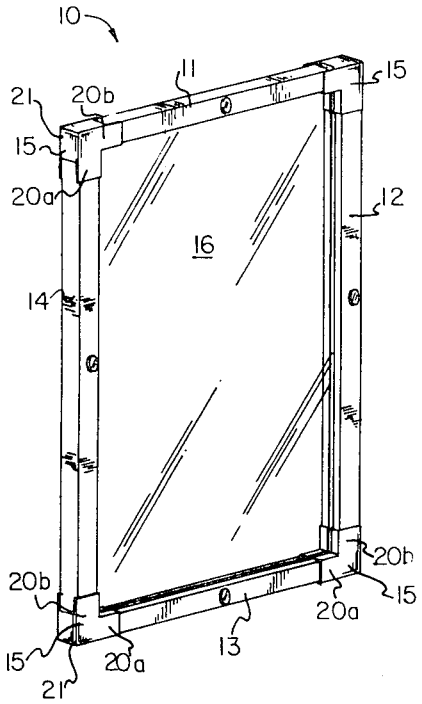

Referring now to the drawing:

In the illustrated preferred embodiment, the window assembly of the invention, shown generally at 10, includes side members 11, 12, 13 and 14, interconnected by corner members 15. A rectangular pane of transparent material made of glass, acrylic resin, or the like, has its edges each inserted into a groove 17 formed in and extending the full length of the side members 11, 12, 13, and 14.

A spring wire 18, or other suitable biasing element, is adapted to be positioned in each groove 17 and to extend essentially the full length thereof. The spring wires 18 are thus positioned between the edges of the pane 16 and bottom of the grooves 17 to bias the side members away from the edge of the pane. Each end of each side member is beveled, preferably on a forty-five degree angle to be inserted into one leg of a corner member 15. Pivot pins 19 are inserted through holes **19*a* provided therefor in the side members and through corresponding larger holes 19*b*** in the edges of the windowpane to hold the assembly together in the same manner as the window structure of U.S. Pat. No. 4,196,545 is held together.

Figure 2:
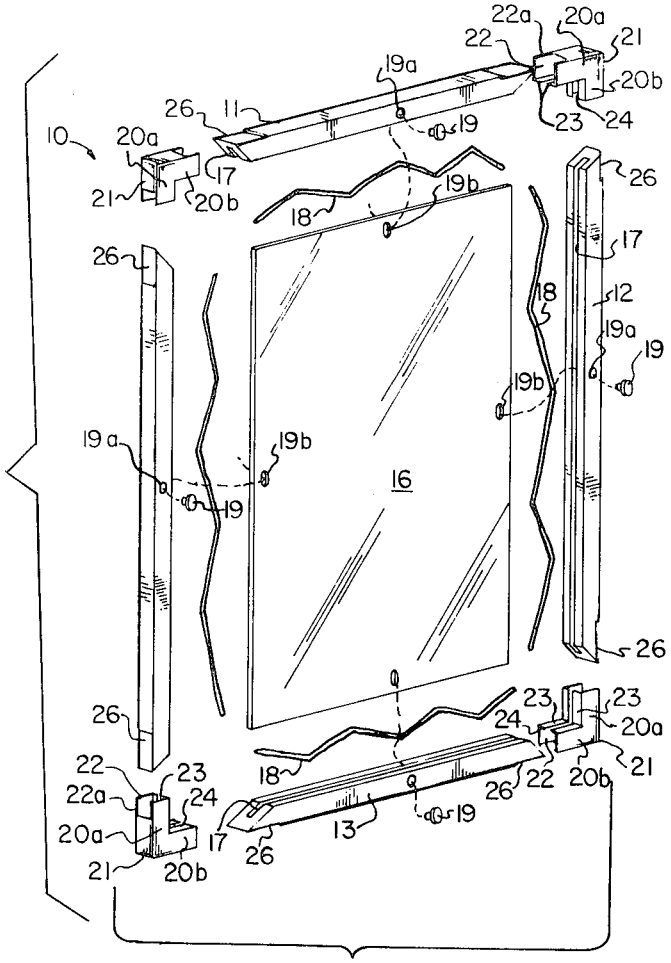
Figure 3:
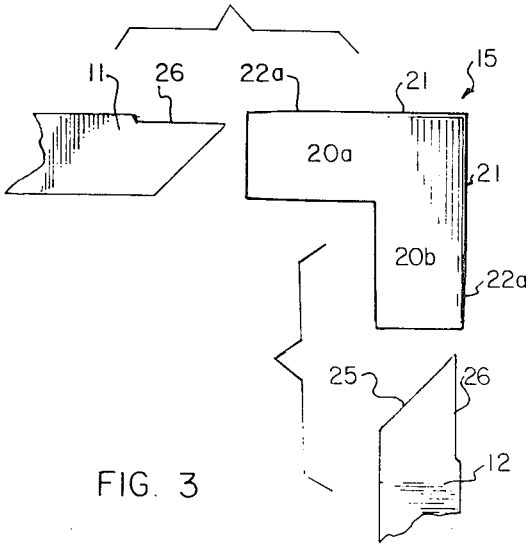

In the preferred embodiment of the invention shown in FIGS. 1–3, the corner pieces 15 which may be of metal, plastic, or other suitable material, each include right-angle legs **20*a* and 20*b* joined at a common back 21. The legs each include side plates that extend beyond the common back at 22 and that have projecting edges 22*a* flush with the surface of the common back 21. Inturned flanges 23 of the side faces are spaced apart to provide an opening 24 that is in alignment with the grooves 17 of the end members. The ends 25 of each of the side members are preferably beveled at a forty-five degree angle so that when the side members are fully inserted into a corner member 15** adjacent side members will be in engagement with their beveled ends flush with one another.

Each side member 11–14 has a notch 26 formed at each end thereof, with the notches arranged to fit beneath the back 21 of corner member 15 into which the side member is inserted. The notches 26 permit the side members to be pulled from the corner members and angulated as the side members are adjusted by the springs 18 to fit different sizes and shapes of openings. The side plates 22 prevent air flow across the notches 26, even when the notches are pulled from beneath back 21.

Figure 4:
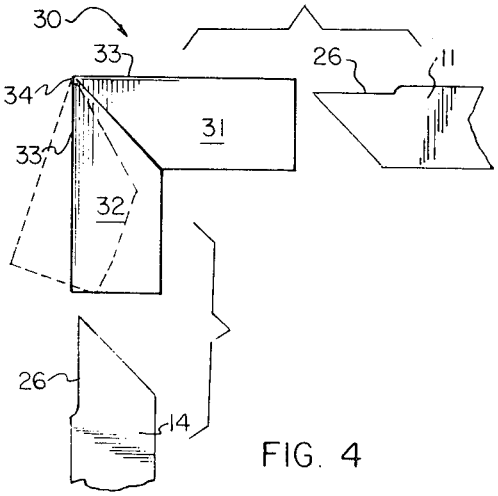

Another embodiment of the invention is shown in FIG. 4. As shown, the corner 30 is suitable for use in the window assembly 10 in the same manner as corner 15 previously described with side members 11 and 14 adapted to be respectively inserted into legs 31 and 32 of the corner 30. As with corner 15, corner 30 includes side plates 31, an opening (not shown) to be in alignment with the grooves 17 of the side members and a common back 33 interconnecting the legs 31 and 32. In this embodiment, however, the back extends to both legs 31 and 32 from a hinge 34 that will permit angular movement of the legs 31 and 32 relative to one another.

When the corners 30 are used in the window assembly 10 the hinges 34 of the corners permit angular adjustment of the corners and fitting of the window assembly into openings of different sizes and shapes.

The window assembly of the invention can be inserted into a window opening either as the sole window assembly to fit in the opening, or as a secondary insulating window assembly. The springs 18 will hold the window assembly in place in the window opening and the corners will permit adjustment of the side members to the shape and size of the opening without gaps or openings across the assembly.

Although preferred embodiments of my invention have been herein disclosed, it is to be understood that departures may be made therefrom without departing from the scope of the claims, which claims are to include any and all equivalent devices and structures.

I claim:

1. A self-adjusting window frame unit comprising a rectangular windowpane;

four elongate end members arranged to surround the rectangular windowpane extending into a slot formed in an end member;

a pin through each end member centrally of its length and through a hole larger than the pin in the windowpane;

biasing means in the slot of each end member biasing the windowpane from the slot;

corner means at each corner formed by adjacent end members, said corner means including a pair of legs, each having slot means to receive a windowpane edge and to be aligned with slot means in an end member and each leg receiving one end of an end member therein, a common back extending to each leg and opposite side faces projecting from the common back and having edges, each providing a continuation of the common back surface; and a notch in each end member whereby the end of the end member will fit into a leg of a corner member with the notch fitting inside the back and a surface of the end member being flush with the common back surface.

2. A self-adjusting window frame unit as in claim 1, wherein the common back includes a hinge, whereby the legs are pivoted with respect to one another.

3. A self-adjusting window frame unit as in claim 2, wherein one leg slides over the other during privoting of the legs with respect to one another.

* * * * *